US011085173B2

(12) United States Patent
Kondo et al.

(10) Patent No.: US 11,085,173 B2
(45) Date of Patent: Aug. 10, 2021

(54) HYDRAULIC SYSTEM OF CONSTRUCTION MACHINE

(71) Applicant: KAWASAKI JUKOGYO KABUSHIKI KAISHA, Kobe (JP)

(72) Inventors: Akihiro Kondo, Kobe (JP); Naoki Hata, Akashi (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 0 days.

(21) Appl. No.: 16/976,617

(22) PCT Filed: Feb. 25, 2019

(86) PCT No.: PCT/JP2019/007092
§ 371 (c)(1),
(2) Date: Aug. 28, 2020

(87) PCT Pub. No.: WO2019/167890
PCT Pub. Date: Sep. 6, 2019

(65) Prior Publication Data

US 2021/0003150 A1 Jan. 7, 2021

(30) Foreign Application Priority Data

Feb. 28, 2018 (JP) ..... JP2018-034521

(51) Int. Cl.
*E02F 9/22* (2006.01)
*F15B 11/08* (2006.01)
*F15B 13/04* (2006.01)

(52) U.S. Cl.
CPC ..... *E02F 9/2282* (2013.01); *E02F 9/2278* (2013.01); *F15B 11/08* (2013.01); *F15B 2013/0413* (2013.01); *F15B 2211/45* (2013.01)

(58) Field of Classification Search
CPC ..... F15B 2211/45; F15B 2013/0413; F15B 2211/31116; E02F 9/2282
See application file for complete search history.

(56) References Cited

U.S. PATENT DOCUMENTS 3,303,753 A * 2/1967 Mccay, Jr. ..... F15B 11/16 91/520
3,439,709 A * 4/1969 Bernhoft ..... F15B 11/042 137/596.13

(Continued)

FOREIGN PATENT DOCUMENTS

JP 4232784 B2 3/2009

*Primary Examiner* — Thomas E Lazo
(74) *Attorney, Agent, or Firm* — Oliff PLC

(57) ABSTRACT

A hydraulic system of a construction machine includes: a pump that supplies hydraulic oil to a hydraulic actuator; a control valve on a center bypass line extending from the pump to a tank, the control valve including a bypass passage; an unloading valve on the center bypass line downstream of the control valve; and a controller that controls the unloading valve. The control valve is configured such that an opening area of the bypass passage is greater than an opening area of the unloading valve while an operation signal outputted from an operation device increases from a predetermined value to a first setting value, and such that the opening area of the bypass passage is less than or equal to ¼ of a maximum opening area of the bypass passage when the operation signal is greater than or equal to a second setting value greater than the first setting value.

12 Claims, 5 Drawing Sheets

(56) References Cited

U.S. PATENT DOCUMENTS

| | | | | |
|---|---|---|---|---|
| 4,633,666 | A * | 1/1987 | Karakama | E02F 9/2239 60/421 |
| 9,494,167 | B2 * | 11/2016 | Mamei | E02F 9/225 |
| 9,790,665 | B2 * | 10/2017 | Tajima | F15B 11/167 |
| 2007/0169474 | A1 | 7/2007 | Oka et al. | |
| 2020/0190770 | A1 * | 6/2020 | Nakajima | F15B 13/0401 |

* cited by examiner

HYDRAULIC SYSTEM OF CONSTRUCTION MACHINE

TECHNICAL FIELD

The present invention relates to a hydraulic system of a construction machine.

BACKGROUND ART

In construction machines such as hydraulic excavators and hydraulic cranes, the components thereof are driven by a hydraulic drive system. For example, Patent Literature 1 discloses a hydraulic system 100 of a hydraulic excavator as shown in FIG. 7.

Specifically, the hydraulic system 100 includes and first pump 111 and a second pump 112. The first pump 111 supplies hydraulic oil to a first group of hydraulic actuators, such as a boom cylinder. The second pump 112 supplies the hydraulic oil to a second group of hydraulic actuators, such as an arm cylinder. A first center bypass line 121 extends from the first pump 111 to a tank. A plurality of control valves 131 are disposed on the first center bypass line 121. Similarly, a second center bypass line 122 extends from the second pump 112 to the tank. A plurality of control valves 132 are disposed on the second center bypass line 122.

Each of the control valves 131 and 132 controls the flow rate of the hydraulic oil supplied to a corresponding one of the hydraulic actuators in accordance with an operating amount of a corresponding one of operation devices 170. To be more specific, each of the control valves 131 and 132 includes a center bypass passage that forms a part of the center bypass line (121 or 122), and is configured such that the opening area of the center bypass passage gradually decreases in accordance with increase in the operating amount of the corresponding operation device 170.

Upstream of all the control valves 131, an unloading line (also referred to as a bleed-off line) 151 is branched off from the first center bypass line 121, and the unloading line 151 is provided with an unloading valve (also referred to as a bleed-off valve) 161. In addition, downstream of all the control valves 131, a bypass cut valve 141 is provided on the first center bypass line 121.

Similarly, upstream of all the control valves 132, an unloading line 152 is branched off from the second center bypass line 122, and the unloading line 152 is provided with an unloading valve 162. In addition, downstream of all the control valves 132, a bypass cut valve 142 is provided on the second center bypass line 122.

The unloading valves 161 and 162 and the bypass cut valves 141 and 142 are controlled by a controller 190 via solenoid proportional valves 181 and 182. At normal times, in a state where the bypass cut valves 141 and 142 are in a blocking position B, the unloading valves 161 and 162 move between an unloading position A and a blocking position B. The controller 190 controls each unloading valve (161 or 162), such that the opening area of the unloading valve decreases in accordance with increase in the operating amount of the operation device 170 for a hydraulic actuator of the first group or in accordance with increase in the operating amount of the operation device 170 for a hydraulic actuator of the second group. That is, at normal times, the unloading flow rate (bleed flow rate) is controlled electrically.

On the other hand, at the time of failure, such as when an electrical path is cut off or when the controller 190 fails, the unloading valves 161 and 162 are switched to a fail-safe position C to close the unloading lines 151 and 152. Also, the bypass cut valves 141 and 142 are switched to a fail-safe position A to open the center bypass lines 121 and 122. Consequently, also at the time of failure, in accordance with the operating amount of each operation device 170, the flow rate of the hydraulic oil supplied to the corresponding hydraulic actuator is controlled.

CITATION LIST

Patent Literature

PLT 1: Japanese Patent No. 4232784

SUMMARY OF INVENTION

Technical Problem

However, in order to achieve fail-safe in the hydraulic system 100 shown in FIG. 7, two valves (an unloading valve and a bypass cut valve) need to be provided for one pump. This results in high cost.

In view of the above, an object of the present invention is to provide a hydraulic system of a construction machine, the hydraulic system making it possible to achieve, with an inexpensive configuration, both electrical control of the unloading flow rate at normal times and fail-safe.

Solution to Problem

In order to solve the above-described problems, a hydraulic system of a construction machine according to the present invention includes: at least one hydraulic actuator; a pump that supplies hydraulic oil to the hydraulic actuator; at least one operation device that receives an operation for moving the hydraulic actuator, and outputs an operation signal corresponding to an operating amount of the operation device; a center bypass line that extends from the pump to a tank; at least one control valve that is disposed on the center bypass line and controls a flow rate of the hydraulic oil supplied to the hydraulic actuator, the control valve including a bypass passage that forms a part of the center bypass line and moving in accordance with the operation signal outputted from the operation device; an unloading valve provided on the center bypass line downstream of the control valve, the unloading valve being configured such that an opening area of the unloading valve is maximized when the unloading valve is in a normal position; and a controller that controls the unloading valve, such that the opening area of the unloading valve decreases in accordance with increase in the operation signal outputted from the operation device, and such that the opening area of the unloading valve is zero when the operation signal is a first setting value. The control valve is configured such that an opening area of the bypass passage is greater than the opening area of the unloading valve while the operation signal increases from a predetermined value to the first setting value, and such that the opening area of the bypass passage is less than or equal to ¼ of a maximum opening area of the bypass passage when the operation signal is greater than or equal to a second setting value greater than the first setting value.

According to the above configuration, while the operation signal outputted from the operation device increases from the predetermined value to the first setting value, the opening area of the bypass passage of the control valve is greater than the opening area of the unloading valve. Accordingly, the unloading flow rate can be electrically controlled by using the unloading valve, which is positioned downstream of the control valve. Meanwhile, at the time of failure, such as when an electrical path relating to the unloading valve is cut off or when a part of the controller fails, although the opening area of the unloading valve is kept at the maximum opening area, when the operation signal becomes greater than or equal to the second setting value, the opening area of the bypass passage of the control valve becomes small, and thus the delivery pressure of the pump, which is the pressure at the upstream side of the bypass passage, becomes high to a certain extent. This makes it possible to supply the hydraulic oil to the hydraulic actuator and thereby move the hydraulic actuator. In addition, both electrical control of the unloading flow rate at normal times and fail-safe can be achieved with an inexpensive configuration in which one unloading valve is provided for one pump.

The opening area of the bypass passage may be zero when the operation signal is greater than or equal to the second setting value. According to this configuration, at the time of failure, such as when an electrical path relating to the unloading valve is cut off or when a part of the controller fails, if the operation signal becomes greater than or equal to the second setting value, no hydraulic oil flows into the tank through the unloading valve, and thereby energy saving can be realized.

The opening area of the bypass passage may be greater than or equal to 1/100 but less than or equal to 1/4 of the maximum opening area of the bypass passage when the operation signal is greater than or equal to the second setting value. According to this configuration, the adjustment range of the opening area of the unloading valve can be made wide.

The opening area of the bypass passage may be kept at the maximum opening area while the operation signal increases from zero to the first setting value. According to this configuration, the change property of the opening area of the unloading valve can be set relatively freely.

The opening area of the bypass passage may gradually decrease while the operation signal increases from zero to the second setting value. According to this configuration, at the time of failure, such as when an electrical path relating to the unloading valve is cut off or when a part of the controller fails, the hydraulic actuator can be moved even in a region in which the operation signal is relatively small (in a case where the operation device includes an operating lever, a region in which the operating lever is close to the neutral). In other words, an operation signal range over which the hydraulic actuator can be moved can be made closer to the operation signal range of a normal state.

A change property of the opening area of the bypass passage, and a change property of the opening area of the unloading valve, may be each a bent line that is bent at a predetermined value, and the opening area of the bypass passage at the predetermined value may be 1.05 to 6 times the opening area of the unloading valve at the predetermined value. According to this configuration, the above-described advantageous effect that the hydraulic actuator can be moved even in a region in which the operation signal is relatively small can be obtained more assuredly for various hydraulic actuators.

Advantageous Effects of Invention

The present invention makes it possible to achieve, with an inexpensive configuration, both electrical control of the unloading flow rate at normal times and fail-safe.

DESCRIPTION OF EMBODIMENTS

Figure 1:
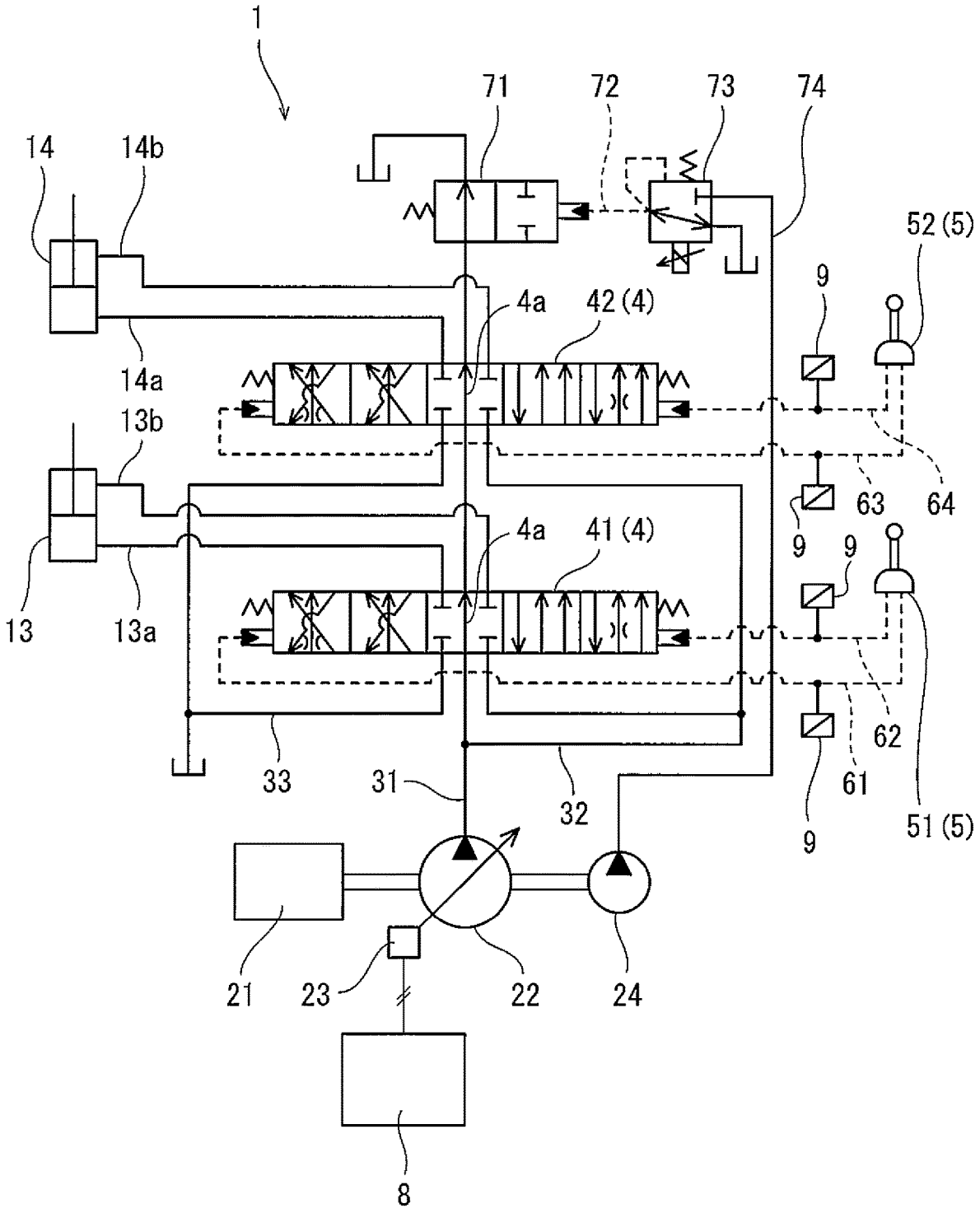
FIG. 1 shows a schematic configuration of a hydraulic system of a construction machine according to one embodiment of the present invention.
Figure 2:
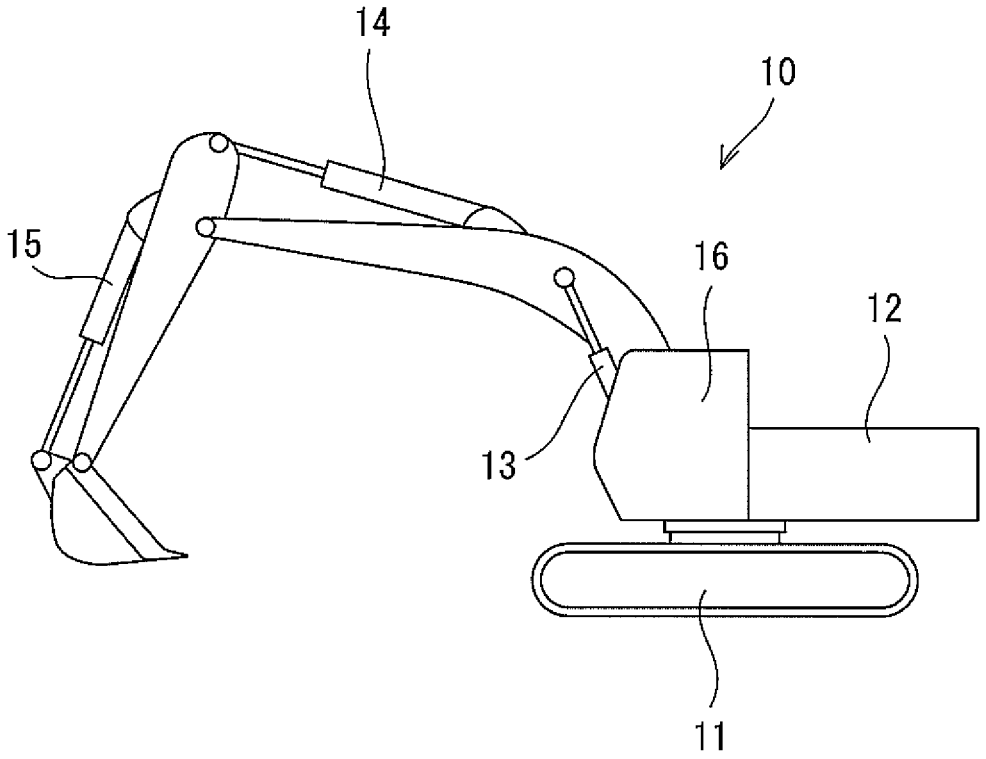
FIG. 2 is a side view of a hydraulic excavator that is one example of the construction machine.

FIG. 1 shows a hydraulic system 1 of a construction machine according to one embodiment of the present invention. FIG. 2 shows a construction machine 10, in which the hydraulic system 1 is installed. Although the construction machine 10 shown in FIG. 2 is a hydraulic excavator, the present invention is applicable to other construction machines, such as a hydraulic crane.

The construction machine 10 shown in FIG. 2 is of a self-propelled type, and includes a traveling unit 11. The construction machine 10 further includes: a slewing unit 12 slewably supported by the traveling unit 11; and a boom that is luffed relative to the slewing unit 12. An arm is swingably coupled to the distal end of the boom, and a bucket is swingably coupled to the distal end of the arm. The slewing unit 12 is equipped with a cabin 16. An operator's seat is installed in the cabin 16. It should be noted that the construction machine 10 need not be of a self-propelled type.

The hydraulic system 1 includes, as hydraulic actuators, a boom cylinder 13, an arm cylinder 14, and a bucket cylinder 15, which are shown in FIG. 2, and also an unshown pair of right and left travel motors and a slewing motor. The boom cylinder 13 luffs the boom. The arm cylinder 14 swings the arm. The bucket cylinder 15 swings the bucket.

As shown in FIG. 1, the hydraulic system 1 further includes a main pump 22, which supplies hydraulic oil to the aforementioned hydraulic actuators. It should be noted that, in FIG. 1, the hydraulic actuators other than the boom cylinder 13 and the arm cylinder 14 are not shown for the purpose of simplifying the drawing.

Figure 7:
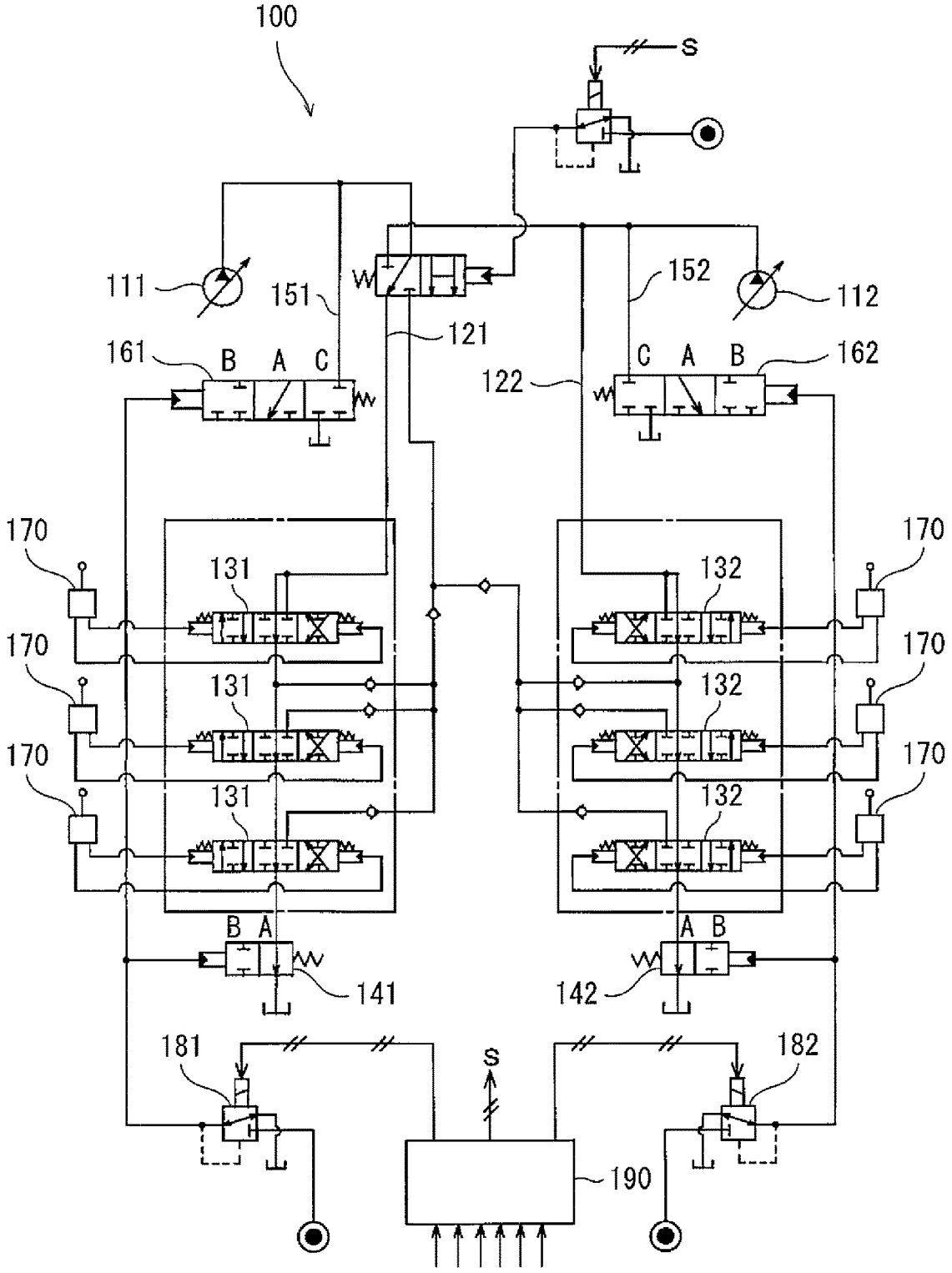
Fig.7 RELATED ART
FIG. 7 shows a schematic configuration of a hydraulic system of a conventional hydraulic excavator.

The main pump 22 is driven by an engine 21. Alternatively, the main pump 22 may be driven by an electric motor. The engine 21 also drives an auxiliary pump 24. Similar to the conventional hydraulic system 100 shown in FIG. 7, a plurality of main pumps 22 may be installed.

The main pump 22 is a variable displacement pump (swash plate pump or bent axis pump) whose tilting angle is changeable. The tilting angle of the main pump 22 is adjusted by a regulator 23.

In the present embodiment, the delivery flow rate of the main pump 22 is controlled by electrical positive control. Accordingly, the regulator 23 moves in accordance with an electrical signal. For example, in a case where the main pump 22 is a swash plate pump, the regulator 23 may electrically change hydraulic pressure applied to a servo piston coupled to the swash plate of the main pump 22, or may be an electric actuator coupled to the swash plate of the main pump 22.

Alternatively, the delivery flow rate of the main pump 22 may be controlled by hydraulic negative control. In this case, the regulator 23 moves in accordance with hydraulic pressure. Further alternatively, the delivery flow rate of the main pump 22 may be controlled by load-sensing control.

A center bypass line 31 extends from the main pump 22 to a tank. A plurality of control valves 4 including a boom control valve 41 and an arm control valve 42 are disposed on the center bypass line 31. It should be noted that, in FIG. 1, the control valves 4 other than the boom control valve 41 and the arm control valve 42 are not shown for the purpose of simplifying the drawing.

All the control valves 4 are connected to the main pump 22 by a supply line 32, and connected to the tank by a tank line 33. It should be noted that the upstream-side portion of the supply line 32 and the upstream-side portion of the center bypass line 31 form a common passage. Each of the control valves 4 is connected to a corresponding one of the hydraulic actuators by a pair of supply/discharge lines. For example, the boom control valve 41 is connected to the boom cylinder 13 by a pair of supply/discharge lines 13*a* and 13*b*, and the arm control valve 42 is connected to the arm cylinder 14 by a pair of supply/discharge lines 14*a* and 14*b*. Each control valve 4 controls the flow rate of the hydraulic oil supplied to the corresponding hydraulic actuator.

A plurality of operation devices 5 including a boom operation device 51 and an arm operation device 52 are disposed in the cabin 16. Each of the operation devices 5 includes an operating unit (an operating lever or a foot pedal) that receives an operation for moving a corresponding one of the hydraulic actuators, and outputs an operation signal corresponding to an operating amount of the operating unit. Each of the control valves 4 moves in accordance with the operation signal outputted from a corresponding one of the operation devices 5.

For example, when the operating lever of the boom operation device 51 is inclined in a boom raising direction, the boom operation device 51 outputs a boom raising operation signal corresponding to the inclination angle of the operating lever, and when the operating lever is inclined in a boom lowering direction, the boom operation device 51 outputs a boom lowering operation signal corresponding to the inclination angle of the operating lever. Similarly, when the operating lever of the arm operation device 52 is inclined in an arm crowding direction, the arm operation device 52 outputs an arm crowding operation signal corresponding to the inclination angle of the operating lever, and when the operating lever is inclined in an arm pushing direction, the arm operation device 52 outputs an arm pushing operation signal corresponding to the inclination angle of the operating lever.

In the present embodiment, each control valve 4 includes a pair of pilot ports, and each operation device 5 is a pilot operation valve that outputs a pilot pressure as an operation signal. Accordingly, each operation device 5 is connected to the pilot ports of the corresponding control valve 4 by a pair of pilot lines. For example, the boom operation device 51 is connected to the pilot ports of the boom control valve 41 by a pair of pilot lines 61 and 62, and the arm operation device 52 is connected to the pilot ports of the arm control valve 42 by a pair of pilot lines 63 and 64.

Alternatively, each operation device 5 may be an electrical joystick that outputs an electrical signal as an operation signal. In this case, solenoid proportional valves may be connected to the respective pilot ports of each control valve 4, or each control valve 4 may be a solenoid pilot valve. In the case where solenoid proportional valves are connected to the respective pilot ports of each control valve 4, each control valve 4 is controlled by a controller 8 via the solenoid proportional valves, whereas in the case where each control valve 4 is a solenoid pilot valve, each control valve 4 is directly controlled by the controller 8. The controller 8 will be described below.

The pair of pilot lines between each operation device 5 and the pilot ports of the corresponding control valve 4 is provided with respective pressure sensors 9, each of which detects a pilot pressure serving as an operation signal. The pressure sensors 9 are electrically connected to the controller 8. It should be noted that FIG. 1 shows only part of signal lines for simplifying the drawing.

The controller 8 controls the regulator 23, such that the delivery flow rate of the main pump 22 increases in accordance with increase in the operation signal outputted from each operation device 5. For example, the controller 8 is a computer including a CPU and memories such as a ROM and RAM. The CPU executes a program stored in the ROM.

Downstream of all the control valves 4, an unloading valve 71 is provided on the center bypass line 31. The unloading valve 71 is an open/close valve of a normally open type. When the unloading valve 71 is in a normal position, the opening area Au of the unloading valve 71 is maximized. To be more specific, the unloading valve 71 includes a pilot port, and the opening area Au of the unloading valve 71 decreases in accordance with increase in a pilot pressure led to the pilot port.

The pilot port of the unloading valve 71 is connected to a solenoid proportional valve 73 by a secondary pressure line 72, and the solenoid proportional valve 73 is connected to the auxiliary pump 24 by a primary pressure line 74. The solenoid proportional valve 73 is a direct proportional valve outputting a secondary pressure that indicates a positive correlation with a command current. It should be noted that the pressure of the primary pressure line 74 (the delivery pressure of the auxiliary pump 24) is kept constant by an unshown relief valve.

Figure 3:
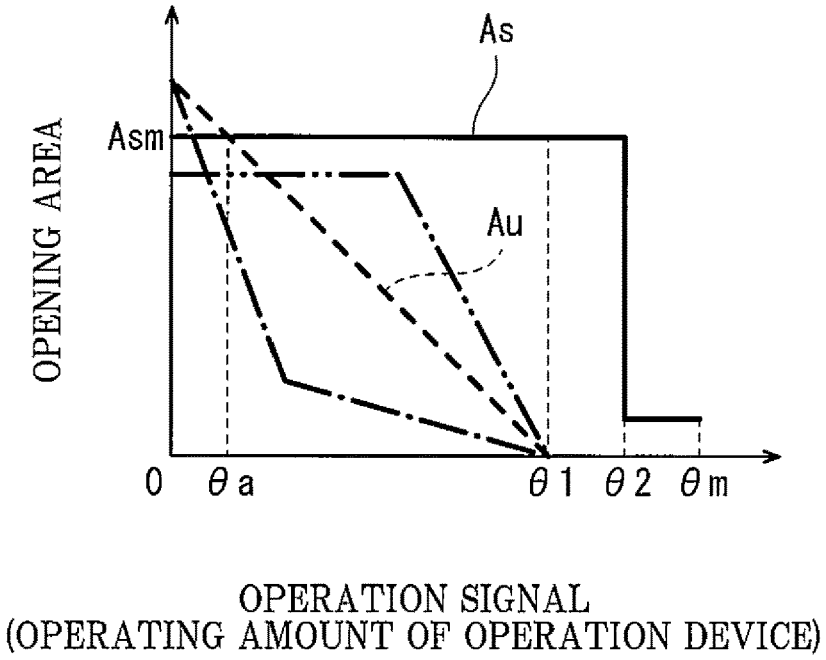
FIG. 3 is a graph showing a relationship in the above embodiment between an operation signal outputted from an operation device, and the opening area of an unloading valve and the opening area of a bypass passage of a control valve.

The unloading valve 71 is controlled by the controller 8 via the solenoid proportional valve 73. Specifically, as shown in FIG. 3, the controller 8 controls the unloading valve 71, such that the opening area Au of the unloading valve 71 decreases in accordance with increase in the operation signal outputted from each operation device 5. The opening area Au of the unloading valve 71 is zero when the operation signal is a first setting value θ1. For example, the first setting value θ1 is set within a range from 50 to 95% of the maximum value θm of the operation signal.

In the present embodiment, the change property of the opening area Au of the unloading valve 71 is a straight line with a constant slope. Alternatively, the change property of the opening area Au of the unloading valve 71 may be a bent line as indicated by a one-dot chain line in FIG. 3, or may be a curve. Further alternatively, the change property of the opening area Au of the unloading valve 71 may be set such that the opening area is kept at the maximum opening area while the operation signal is small, as indicated by a two-dot chain line shown in FIG. 3.

It should be noted that the change property of the opening area Au of the unloading valve 71 may differ depending on the type of the operation signal. For example, the opening area Au of the unloading valve 71 when boom raising is performed may be less than the opening area Au of the unloading valve 71 when arm crowding is performed.

Each control valve 4 includes a bypass passage 4*a*, which forms a part of the center bypass line 31 (see FIG. 1). As shown in FIG. 3, each control valve 4 is configured such that the opening area As of the bypass passage 4*a* is greater than the opening area Au of the unloading valve 71 while the operation signal outputted from the corresponding operation device 5 increases from a predetermined value θa to the first setting value θ1. Each control valve 4 is further configured such that the opening area As of the bypass passage 4*a* is less than or equal to ¼ of the maximum opening area Asm of the bypass passage 4*a* when the operation signal outputted from the corresponding operation device 5 is greater than or equal to a second setting value θ2, which is greater than the first setting value θ1.

While the operation signal increases from the second setting value θ2 to the maximum value θm, the opening area As of the bypass passage 4*a* may decrease gradually, or stay constant. For example, the second setting value θ2 is set within a range from 53 to 98% of the maximum value θm of the operation signal.

Figure 4:
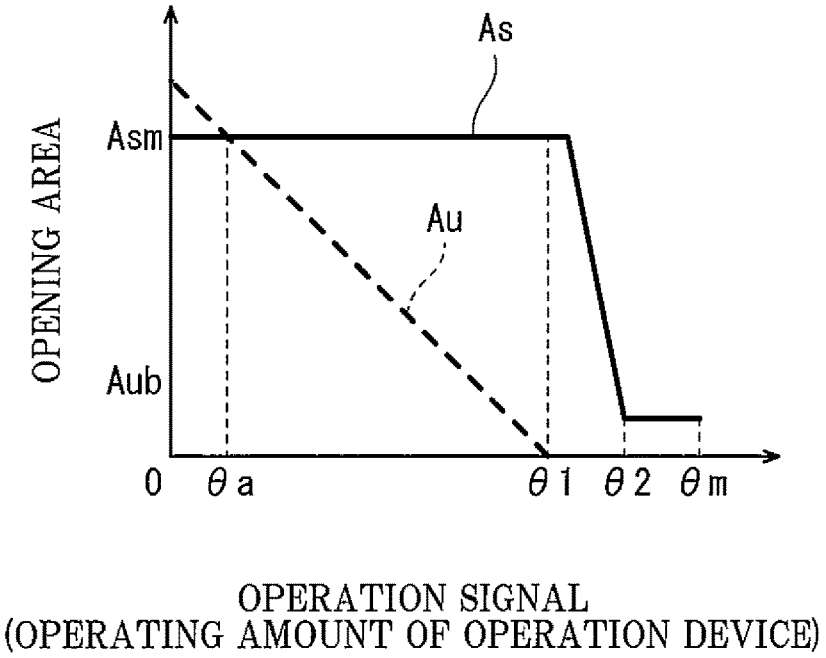
FIG. 4 is a graph showing a relationship in a variation between the operation signal outputted from the operation device, and the opening area of the unloading valve and the opening area of the bypass passage of the control valve.

In the present embodiment, while the operation signal increases from zero to the second setting value θ2, the opening area As of the bypass passage 4*a* is kept at the maximum opening area. However, the opening area As of the bypass passage 4*a* is required to be kept at the maximum opening area only within a range from zero to the first setting value θ1. As shown in FIG. 4, the opening area As of the bypass passage 4*a* may start decreasing from the maximum opening area at a point when the operation signal has become slightly greater than the first setting value θ1.

Further, in the present embodiment, the maximum opening area Asm of the bypass passage 4*a* of each control valve 4 is less than the maximum opening area of the unloading valve 71. For this reason, the predetermined value θa is greater than zero. Alternatively, the maximum opening area Asm of the bypass passage 4*a* of each control valve 4 may be equal to or greater than the maximum opening area of the unloading valve 71. In such a case, the predetermined value θa is zero.

Still further, in the present embodiment, the opening area As of the bypass passage 4*a* is greater than or equal to 1/100 but less than or equal to ¼ of the maximum opening area Asm of the bypass passage 4*a* when the operation signal is greater than or equal to the second setting value θ2. Alternatively, the opening area As of the bypass passage 4*a* may be zero when the operation signal is greater than or equal to the second setting value θ2.

As described above, in the hydraulic system 1 of the present embodiment, while the operation signal outputted from each operation device 5 increases from the predetermined value θa to the first setting value θ1, the opening area As of the bypass passage 4*a* of the corresponding control valve 4 is greater than the opening area Au of the unloading valve 71. Accordingly, the unloading flow rate can be electrically controlled by using the unloading valve 71, which is positioned downstream of all the control valves 4. Meanwhile, at the time of failure, such as when an electrical path relating to the unloading valve is cut off or when a part of the controller fails, although the opening area of the unloading valve 71 is kept at the maximum opening area, when the operation signal outputted from each operation device 5 becomes greater than or equal to the second setting value θ2, the opening area As of the bypass passage 4*a* of the corresponding control valve 4 becomes small, and thus the delivery pressure of the main pump 22, which is the pressure at the upstream side of the bypass passage 4*a*, becomes high to a certain extent. This makes it possible to supply the hydraulic oil to the corresponding hydraulic actuator and thereby move the hydraulic actuator. In addition, both electrical control of the unloading flow rate at normal times and fail-safe can be achieved with an inexpensive configuration in which one unloading valve 71 is provided for one main pump 22.

Further, in the present embodiment, the opening area As of the bypass passage 4*a* of each control valve 4 is kept at the maximum opening area while the operation signal outputted from the corresponding operation device 5 increases from zero to the first setting value θ1. Accordingly, as indicated by the one-dot chain line and the two-dot chain line shown in FIG. 3, the change property of the opening area Au of the unloading valve 71 can be set relatively freely.

It should be noted that in a case where each operation device 5 is an electrical joystick, fail-safe can be achieved, for example, when the unloading valve is malfunctioning but the control valve is functioning normally.

(Variations)

The present invention is not limited to the above-described embodiment. Various modifications can be made without departing from the scope of the present invention.

For example, the opening area As of the bypass passage 4*a* of each control valve 4 may be brought to zero when the operation signal outputted from the corresponding operation device 5 becomes greater than or equal to the second setting value θ2. In this case, at the time of failure, such as when an electrical path relating to the unloading valve 71 is cut off or when a part of the controller fails, if the operation signal becomes greater than or equal to the second setting value θ2, no hydraulic oil flows into the tank through the unloading valve 71, and thereby energy saving can be realized. However, although such energy saving effect is obtained, when taking into consideration, for example, manufacturing errors of the unloading valve 71, the first setting value θ1 cannot be set too close to the second setting value θ2. In this respect, if the opening area As of the bypass passage 4*a* is greater than or equal to 1/100 but less than or equal to ¼ of the maximum opening area Asm of the bypass passage 4*a* when the operation signal is greater than or equal to the second setting value θ2 as in the above-described embodiment, the first setting value θ1 can be set close to the second setting value θ2, and thereby the adjustment range of the opening area Au of the unloading valve 71 can be made wide.

Figure 5:
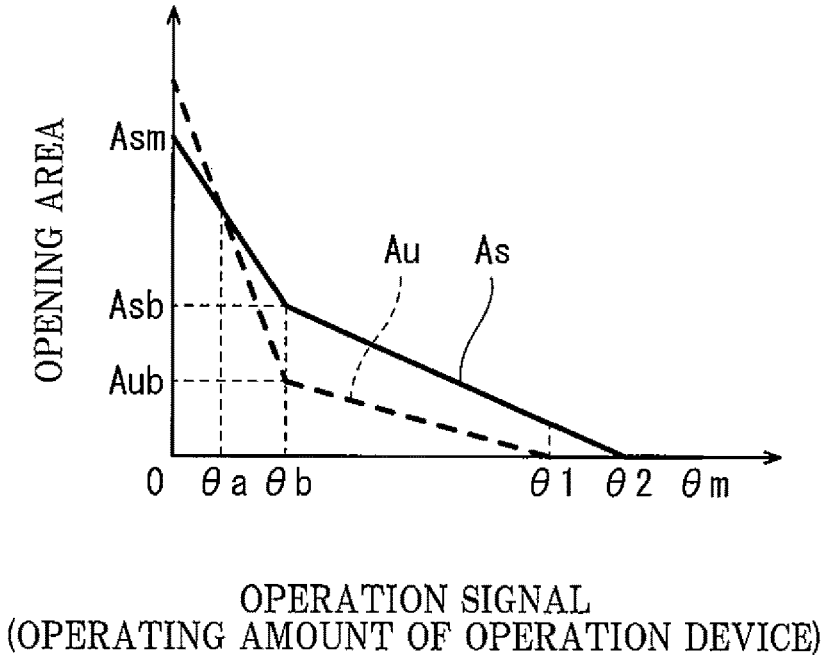
FIG. 5 is a graph showing a relationship in another variation between the operation signal outputted from the operation device, and the opening area of the unloading valve and the opening area of the bypass passage of the control valve.

Further, as shown in FIG. 5, the opening area As of the bypass passage 4*a* of each control valve 4 may gradually decrease while the operation signal outputted from the corresponding operation device 5 increases from zero to the second setting value θ2. According to this configuration, at the time of failure, such as when an electrical path relating to the unloading valve is cut off or when a part of the controller fails, the hydraulic actuator can be moved even in a region in which the operation signal is relatively small (in a case where the operation device 5 includes an operating lever, a region in which the operating lever is close to the neutral). In other words, an operation signal range over which the hydraulic actuator can be moved can be made closer to the operation signal range of a normal state.

In the example shown in FIG. 5, the change property of the opening area Au of the unloading valve 71, and the change property of the opening area As of the bypass passage 4*a*, are bent lines, each of which is bent at a predetermined value θb. For example, the predetermined value θb is substantially the same as the operation signal when the meter-in passage of the control valve 4 starts opening. If such a bent line shape is adopted, then at the time of unloading, wasteful pressure loss of the center bypass line 31 can be prevented, and additionally, the control gain of the unloading valve 71 when the meter-in passage starts opening can be lowered (i.e., increase in the opening area Au relative to the operation signal can be reduced).

For example, the opening area Asb of the bypass passage 4*a* at the predetermined value θb is 1.05 to 6 times the opening area Au of the unloading valve 71 at the predetermined value θb. According to this configuration, the above-described advantageous effect that the hydraulic actuator can be moved even in a region in which the operation signal is relatively small can be obtained more assuredly for various hydraulic actuators.

Figure 6:
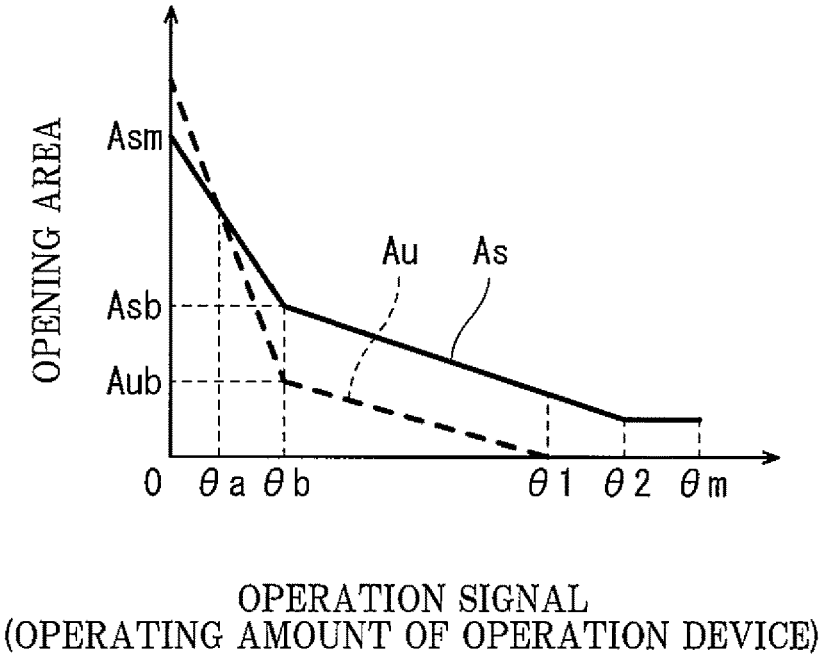
FIG. 6 is a graph showing a relationship in yet another variation between the operation signal outputted from the operation device, and the opening area of the unloading valve and the opening area of the bypass passage of the control valve.

Further, in the example shown in FIG. 5, the opening area As of the bypass passage 4*a* when the operation signal is greater than or equal to the second setting value θ2 is zero. Alternatively, as shown in FIG. 6, the opening area As of the bypass passage 4*a* when the operation signal is greater than or equal to the second setting value θ2 may be greater than or equal to 1/100 but less than or equal to ¼ of the maximum opening area Asm of the bypass passage 4*a*. The same advantages effect as that described above can be obtained regardless of whether the opening area As of the bypass passage 4*a* is zero or not zero when the operation signal is greater than or equal to the second setting value θ2.

Still further, in a case where the decrease rate of the opening area Au of the unloading valve 71 changes at the predetermined value θb as shown in FIG. 5, the change property of the opening area Au from the predetermined value θb to the first setting value θ1 may be constituted by a plurality of straight lines having different slopes from each other. The adoption of such a bent line shape makes it possible to make better use of the aforementioned characteristics, i.e., at the time of unloading, wasteful pressure loss of the center bypass line 31 can be prevented, and additionally, the control gain of the unloading valve 71 when the meter-in passage starts opening can be lowered (i.e., increase in the opening area Au relative to the operation signal can be reduced).

REFERENCE SIGNS LIST

1 hydraulic system
10 construction machine
13 boom cylinder (hydraulic actuator)
14 arm cylinder (hydraulic actuator)
22 main pump
4 control valve
4*a* bypass passage
5 operation device
71 unloading valve
8 controller

The invention claimed is:

1. A hydraulic system of a construction machine, comprising:

at least one hydraulic actuator;

a pump that supplies hydraulic oil to the hydraulic actuator;

at least one operation device that receives an operation for moving the hydraulic actuator, and outputs an operation signal corresponding to an operating amount of the operation device;

a center bypass line that extends from the pump to a tank;

at least one control valve that is disposed on the center bypass line and controls a flow rate of the hydraulic oil supplied to the hydraulic actuator, the control valve including a bypass passage that forms a part of the center bypass line and moving in accordance with the operation signal outputted from the operation device;

an unloading valve provided on the center bypass line downstream of the control valve, the unloading valve being configured such that an opening area of the unloading valve is maximized when the unloading valve is in a normal position; and a controller that controls the unloading valve, such that the opening area of the unloading valve decreases in accordance with increase in the operation signal outputted from the operation device, and such that the opening area of the unloading valve is zero when the operation signal is a first setting value, wherein the control valve is configured such that an opening area of the bypass passage is greater than the opening area of the unloading valve while the operation signal increases from a predetermined value to the first setting value, and such that the opening area of the bypass passage is less than or equal to ¼ of a maximum opening area of the bypass passage when the operation signal is greater than or equal to a second setting value greater than the first setting value.

2. The hydraulic system of a construction machine according to claim 1, wherein the opening area of the bypass passage is zero when the operation signal is greater than or equal to the second setting value.

3. The hydraulic system of a construction machine according to claim 2, wherein the opening area of the bypass passage is kept at the maximum opening area while the operation signal increases from zero to the first setting value.

4. The hydraulic system of a construction machine according to claim 2, wherein the opening area of the bypass passage gradually decreases while the operation signal increases from zero to the second setting value.

5. The hydraulic system of a construction machine according to claim 4, wherein a change property of the opening area of the bypass passage, and a change property of the opening area of the unloading valve, are each a bent line that is bent at a predetermined value, and the opening area of the bypass passage at the predetermined value is 1.05 to 6 times the opening area of the unloading valve at the predetermined value.

6. The hydraulic system of a construction machine according to claim 1, wherein the opening area of the bypass passage is greater than or equal to 1/100 but less than or equal to ¼ of the maximum opening area of the bypass passage when the operation signal is greater than or equal to the second setting value.

7. The hydraulic system of a construction machine according to claim 6, wherein the opening area of the bypass passage is kept at the maximum opening area while the operation signal increases from zero to the first setting value.

8. The hydraulic system of a construction machine according to claim 6, wherein the opening area of the bypass passage gradually decreases while the operation signal increases from zero to the second setting value.

9. The hydraulic system of a construction machine according to claim 8, wherein a change property of the opening area of the bypass passage, and a change property of the opening area of the unloading valve, are each a bent line that is bent at a predetermined value, and the opening area of the bypass passage at the predetermined value is 1.05 to 6 times the opening area of the unloading valve at the predetermined value.

10. The hydraulic system of a construction machine according to claim 1, wherein the opening area of the bypass passage is kept at the maximum opening area while the operation signal increases from zero to the first setting value.

11. The hydraulic system of a construction machine according to claim 1, wherein the opening area of the bypass passage gradually decreases while the operation signal increases from zero to the second setting value.

12. The hydraulic system of a construction machine according to claim 11, wherein a change property of the opening area of the bypass passage, and a change property of the opening area of the unloading valve, are each a bent line that is bent at a predetermined value, and the opening area of the bypass passage at the predetermined value is 1.05 to 6 times the opening area of the unloading valve at the predetermined value.

* * * * *